United States Patent [19]

Meenen et al.

[11] 4,264,066

[45] Apr. 28, 1981

[54] MACHINE FOR FOLDING CURTAINS AND THE LIKE

[75] Inventors: Raymond Meenen, Hawthorne; Stewart Olsen, Little Ferry; Vincent Bonnema, Clifton, all of N.J.

[73] Assignee: Mayflower Electronic Devices, Inc., Little Ferry, N.J.

[21] Appl. No.: 32,527

[22] Filed: Apr. 23, 1979

[51] Int. Cl.[3] ..... B65H 45/18

[52] U.S. Cl. ..... 493/12; 493/23; 493/28; 493/442; 493/937

[58] Field of Search ..... 270/67, 61 R, 62, 66, 270/68, 84, 85, 83, 81, 93

[56] References Cited

U.S. PATENT DOCUMENTS

| | | | |
|---|---|---|---|
| 3,363,897 | 1/1968 | Northern et al. | 270/84 |
| 3,485,492 | 12/1969 | Iltis | 270/84 |
| 3,552,737 | 1/1971 | Iltis | 270/84 |
| 3,883,131 | 5/1975 | Anderson, Jr. et al. | 270/85 X |
| 4,057,241 | 11/1977 | Buss et al. | 270/85 |
| 4,059,257 | 11/1977 | Grantham | 270/85 X |

*Primary Examiner*—E. H. Eickholt

[57] ABSTRACT

An air operated electrically controlled machine using constant speed motors and known per se is provided with electronic counter and clock pulse generator control which eliminates uneven folding and over and under folding characteristics of the known machine and wherein separate photocell circuits control the folding operation while enabling much longer lengths of materials to be folded and eliminating jamming characteristics of the known machine.

8 Claims, 16 Drawing Figures

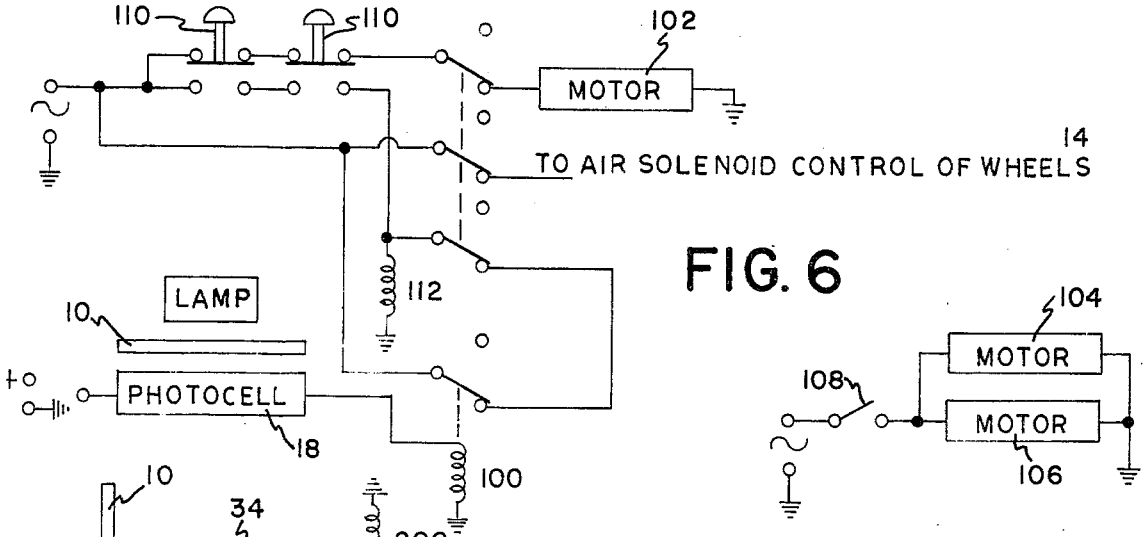
FIG. 6
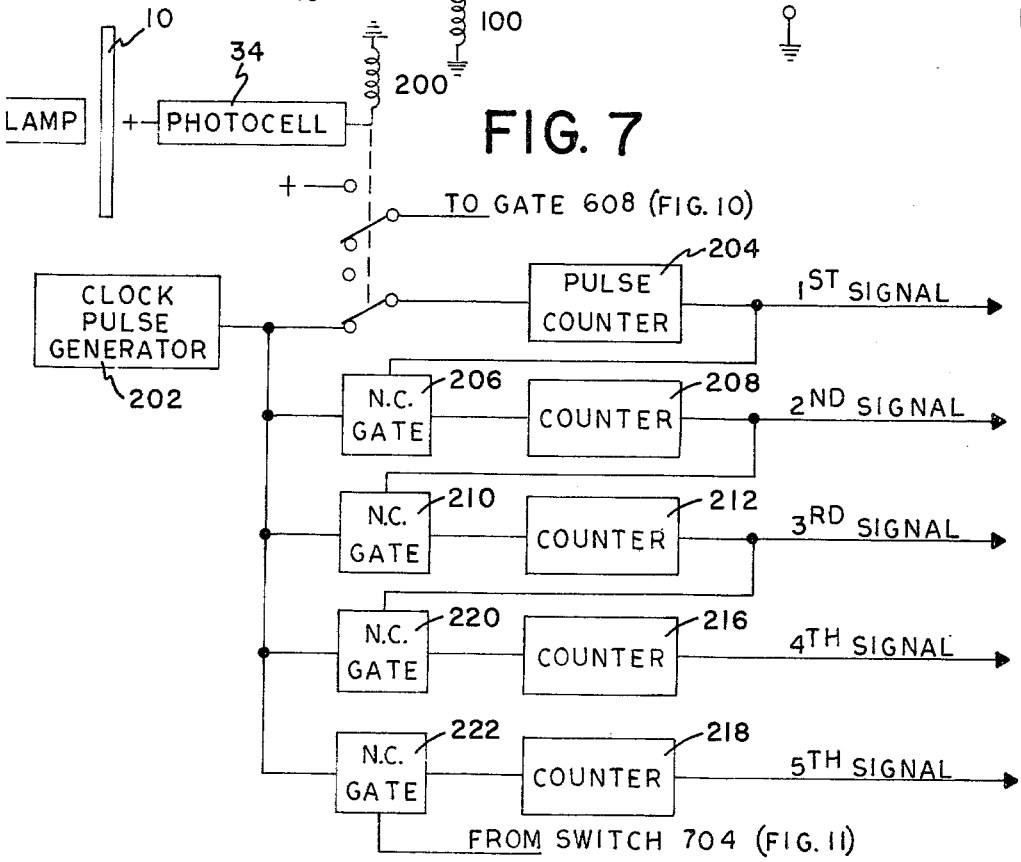
FIG. 7
FIG. 8
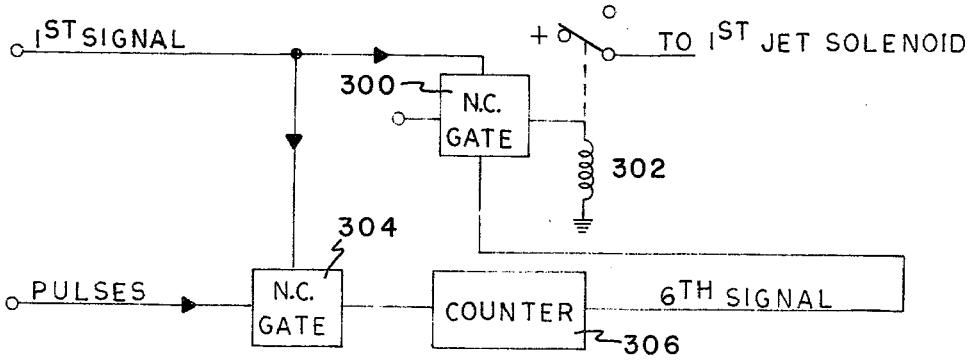

MACHINE FOR FOLDING CURTAINS AND THE LIKE

PRIOR ART STATEMENT

Mayflower Electronic Devices, Inc. of Little Ferry, New Jersey manufactures and sells a machine for folding shower curtains for bathrooms and the like. This machine, identified as a SHOWER CURTAIN FOLDING MACHINE, is an air operated electrically controlled machine employing constant speed electric motors. Five folds are made in the machine. The first three folds are formed by use of three separate air jets, under the control of electromechanical timers, the air jets flowing the material to be folded into the pinch of rubber rollers. The two remaining folds are formed by the use of two separate blades.

In use the curtain to be folded, flat and relatively wrinkle free, is held by two operators, one on each side of the curtain. The operators lift the leading edge of the curtain from a pile and insert it into an input feed section between raised input wheels and a horizontal input roller. The input wheels drop down and clamp the leading edge against the input roller. When the operators actuate start switches, the input roller rotates. The curtain is fed between the input roller and idler rollers, and exits in a vertical plane. The curtain is fed vertically downward past a set of four parallel horizontally elongated vertically spaced rollers which are used to produce the first three folds.

When the leading edge of the curtain reaches a position at which it interrupts the light beam impinging upon a photocell, this beam interruption also initiates the process for producing the first three folds. The set of fold producing rollers is arranged so that the two uppermost rollers (the first and second rollers) are vertically aligned with each other and the two lowermost rollers (the third and fourth rollers) are also vertically aligned with each other. However, the two lowermost rollers are horizontally offset from the two uppermost rollers. (The input rollers stop rotating with the third fold starts.)

When the beam is interrupted, a first relay is energized, completing a circuit actuating a first timer. When the first timer cycles, a first output signal is produced and energizes a second relay. This causes a first set of electrically controlled air solenoids to be energized and first jet of air is discharged horizontally, forcing the curtain between the first two of the parallel rollers. This action produces the first fold.

When the second relay is energized, a holding circuit for the second relay is completed through a first resistor-capacitor time delay network having a selected time constant. The discharge period of the capacitor determines the period of time during which the holding circuit is enabled. When this period is exceeded, the holding circuit is disabled, the second relay is deenergized and the first jet is cut off.

The first output signal in addition to energizing the second relay also actuates a second timer. When the second timer cycles, a second output signal is produced which energizes a third relay. This action completes a circuit actuating a second set of electrically controlled air solenoids which in turn enables a second jet of air to be discharged inclinedly downwards at a selected angle to force the first folded curtain between the second and third rollers to form the second fold. The curtain, during the step of producing the first fold, must be supported in order to be maintained in proper position for the second fold. A stripper belt roller assembly provides this support. After a selected timed interval, the first jet of air is produced, and the stipper assembly is caused to move away from the second and third rollers to support the curtain. Then the discharge of the second jet causes the first folded curtain between the rollers to form the second fold. After another timed interval, the stripper assembly movement is reversed and the stripper assembly is caused to move toward the second and third rollers. Two additional timers are used to control the operation of the stripper belt roller assembly.

When the third relay is energized, a second holding circuit is completed through a second time delay network. The capacitor in this second network discharges in the same manner as in the first network, and the second holding circuit is disabled whereby the second jet is cut off.

The second output signal, in addition to energizing the third relay also actuates a third timer. When the third timer cycles, a third output signal is produced which energizes a fourth relay. This action completes a circuit actuating a third set of electrically controlled solenoids which in turn enables a third jet of air to be discharged horizontally to force the twice folded curtain between the third and fourth rollers to form the third fold. When the fourth relay is energized, a third holding circuit is completed through a third time delay network. The capacitor in this third network discharges in the first manner as in the second network and the third holding circuit is disabled whereby the third jet is cut off.

The thrice folded material is then transported by a first horizontal conveyor to be positioned under a vertical blade lying in a vertical plane disposed at right angles to the four horizontal rollers. The vertical blade then descends and pushes the curtain between a first pair of output rollers to form a fourth and cross fold in the previously thrice folded curtain. The vertical blade then is raised and the cross folded curtain is fed between one of the rollers in the first pair and another roller parallel to and below this one roller. A horizontal blade is then advanced to force the curtain between these last two mentioned rollers to form the fifth and last fold. The horizontal blade is then withdrawn and the folded curtain can be removed via a conveyor for packaging.

A fourth timer actuated by the third output signal controls the folding action of the vertical blade. The vertical blade is raised or lowered by air pressure supplied via a double acting air solenoid. When the fourth timer cycles, a fourth output signal is produced, which energizes a fifth relay and energizes the double acting solenoid to force the vertical blade downward. As the vertical blade bottoms, it engages a reversing switch which energizes the double acting solenoid in reverse sense whereby the vertical blade is raised to its initial position. When the vertical blade bottoms, a fifth timer is actuated to control the folding action of the horizontal blade. The horizontal blade is advanced or withdrawn by air pressure supplied via a second double acting air solenoid. When the fifth timer cycles, a fifth output signal is produced, energizing a sixth relay whereby the second double acting solenoid is energized to move the horizontal blade forward. As the horizontal blade reaches its extreme forward position, it engages a second reversing switch which energizes the second double acting solenoid in reverse sense whereby the horizontal blade is withdrawn to its original position.

BACKGROUND OF THE INVENTION

The machine described in the prior art statement has met with considerable financial success. However, the machine exhibits certain undesirable characteristics which limit its potential usefulness in some newly proposed applications.

For example, the timers employed utilize synchronous motors whereby slight normal frequency variations in the alternating current feed can cause undesired variations in the time of generation of control signals and some of the folds can be formed unevenly. This is particularly disadvantageous when the folded curtains are to be placed in transparent packages since curtains with uneven folds are visually unattractive.

In addition, the time delay networks employ discrete components having values which may change somewhat as the components age and in addition these values are somewhat temperature dependent. These changes in values change the time constant and since the duration of each jet of air is determined by the associated time constant, the actual duration may increase or decrease as compared to the nominal duration desired. Such increases or decreases also adversely effect the folding operation because over or under folding can occur.

Moreover, as has been previously explained, the input roller stops rotating and at the same time the third folding operation is initiated. However, this action limits the length of the curtain that can be folded because unless the curtain is sufficiently short for its trailing edge to have cleared the input section at the time the third fold operates, the trailing edge will be trapped in the input section when the input roller stops rotating and the machine will become jammed.

The present invention is directed toward an improved machine of the type described above wherein the timing of the folding operations and the duration of the various air jets is controlled to a very high degree of precision whereby the folds can be formed evenly without appreciable over and under folding and moreover wherein the lengths of curtains to be folded can be substantially increased without jamming the machine.

SUMMARY OF THE INVENTION

In accordance with the principles of the invention, each of the electromechanical timers previously used is replaced by a separate counter which receives pulses from a clock pulse generator. In addition, the time delay networks are eliminated and additional counters receiving pulses from the same generator are used to determine the duration of each air jet. The pulse generator produces accurately timed pulses which are not influenced by changes in frequency and the counters respond only to the pulses and have no time constants. Consequently, the uneven folding and over and under folding characteristics caused by variations in frequency and changes in time constants cannot occur.

The folding operations are begun in the same manner as in the prior art machine, with the leading edge of the curtain to be folded interrupting the light beam of the photocell. However, in accordance with the principles of the invention, an additional separate photocell control is employed in order to control the operation of the input section. The curtain to be folded interrupts the light beam striking the photocell in this separate control from the instant that the curtain is fed to the input section until the trailing edge of the curtain passes through the light beam and the light beam then is free to strike the photocell. As soon as this beam strikes the photocell, the input section is disabled. Thus, in the invention, the passage of the leading edge of the curtain past one photocell initiates the folding operation while the passage of the trailing edge past another photocell disables the input section. Thus, much longer lengths of curtain can be folded without jamming the machine.

BRIEF DESCRIPTION OF THE DRAWINGS

FIG. 6 is a diagram showing control of the motors.

FIGS. 7–13 are diagrams of various control circuits which illustrate action of the pulse counters and associated apparatus in controlling the folding actions.

DETAILED DESCRIPTION OF PREFERRED EMBODIMENTS

Figures 1, 1A:
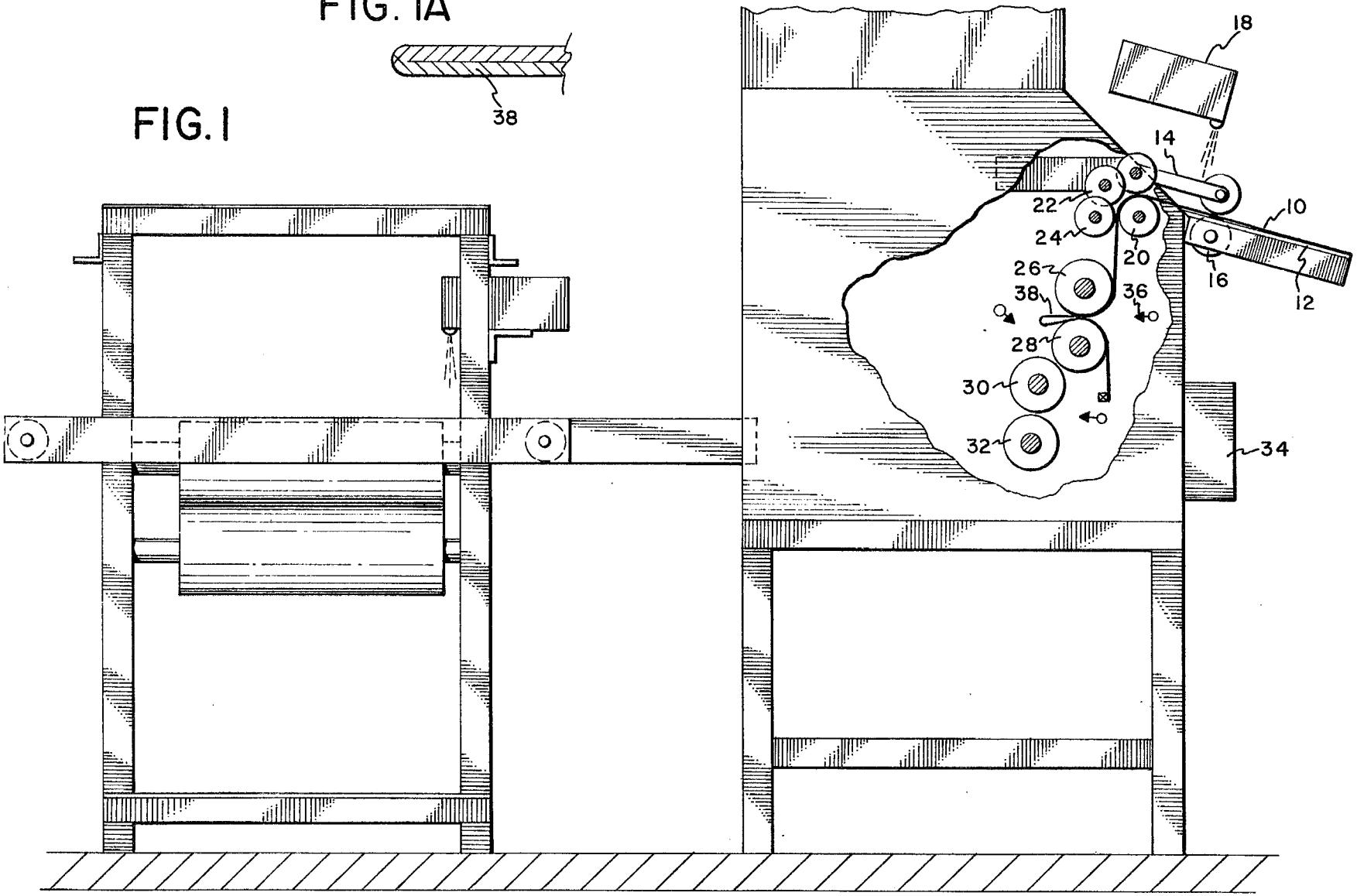
FIG. 1 is a partially cut away view of the machine in process of forming the first fold.
FIG. 1A is a partial sectional view of the first fold.

The machine shown in FIGS. 1–5, with the exception of the photocell arrangements to be described in more detail below, is the machine described in the prior art statement and is only shown and described herein in sufficient detail to enable the invention to be explained and understood.

Referring now to FIGS. 1–5, a curtain 10 (or any other suitable material) to be folded has its leading edge placed in an upwardly inclined plate 12 between raised input wheels 14 and a horizontal input roller 16. The input wheels drop down and clamp the leading edge against the input roller. When the operators actuate start switches, the leading edge breaks the light beam of the first photocell circuit 18. Upon release of start buttons, the input roller rotates and the curtain is fed into a group consisting of another driven horizontal roller 20 and two horizontal idler rollers 22 and 24 whereby the curtain exits in a vertical plane. The curtain is then fed downward past a set of four parallel horizontal vertically spaced driven rollers 26, 28, 30 and 32, which are used to produce the first three folds. The two uppermost rollers 26 and 28 are vertically aligned with each other. The two lowermost rollers 30 and 32 are vertically aligned with each other but are horizontally offset from the two uppermost rollers.

When the leading edge of the curtain reaches a position at which it interrupts the light beam of a second photocell circuit 34, this initiates the process for producing the first three folds.

As the trailing edge of the curtain passes through the first photocell circuit 18, the light beam is no longer interrupted and the input roller section is disabled. The rollers 16 and 20 stop rotating and the input wheels are raised.

The machine timing control will be described in detail below after the folding operations are explained briefly with respect to FIGS. 1–5.

As shown in FIG. 1, discharge of a first horizontal air jet at 36 forces the curtain between rollers 26 and 28 to produce the first fold shown at 38.

The curtain, during the movement following the first fold, must be supported to hold it in proper position for the third fold.

Figure 5:
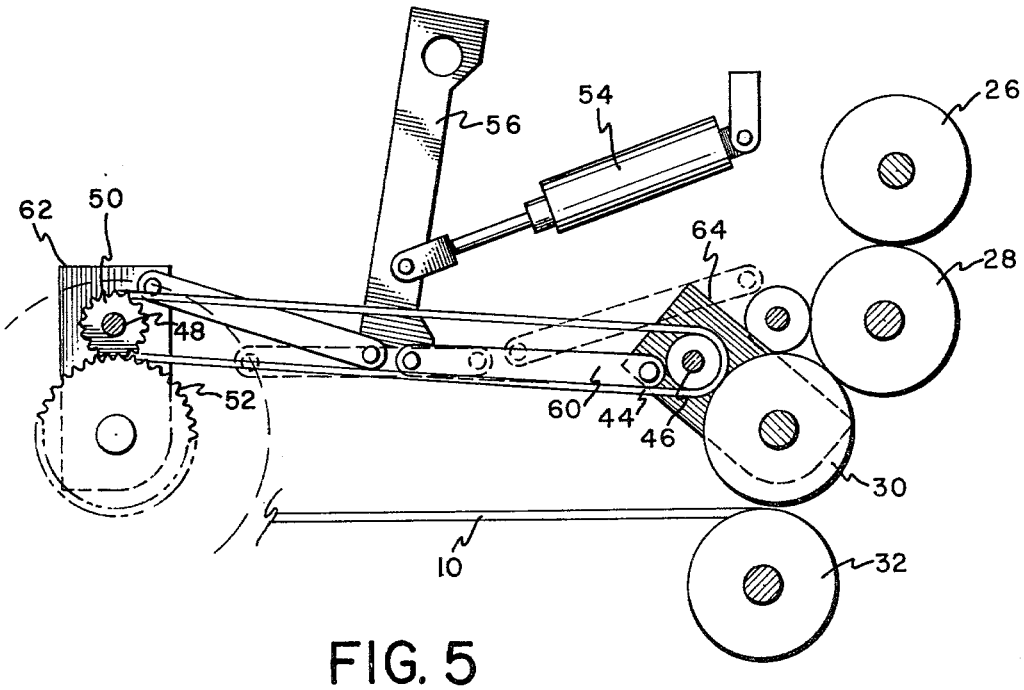
FIG. 5 is a detail view showing the action of the stripper roller assembly.

As shown in FIG. 5, an endless belt has top and bottom portions and is wrapped around two parallel horizontal rollers 46 and 48. Roller 48 carries a small toothed gear 50 which engages a larger toothed driving gear 52. As gear 52 rotates it rotates gear 50 rolling belt 44. A solenoid operated air cylinder 54 is secured to pivoted linkage 56 which in turn is pivotally secured to linkages 58 and 60. Linkages 58 and 60 are secured to pivot plates 62 and 64. The purpose of the air cylinder linkages and plates is to move the belt assembly toward the rollers 28 and 30 or to move the belt assembly away from rollers 28 and 30. When the belt assembly is moved away from rollers 28 and 30, gear 50 is disposed at about the ten o'clock position. The actuation and the deactuation of the air cylinder together with the movement of the linkages and plates produces the gear movement.

Figures 1B, 2:
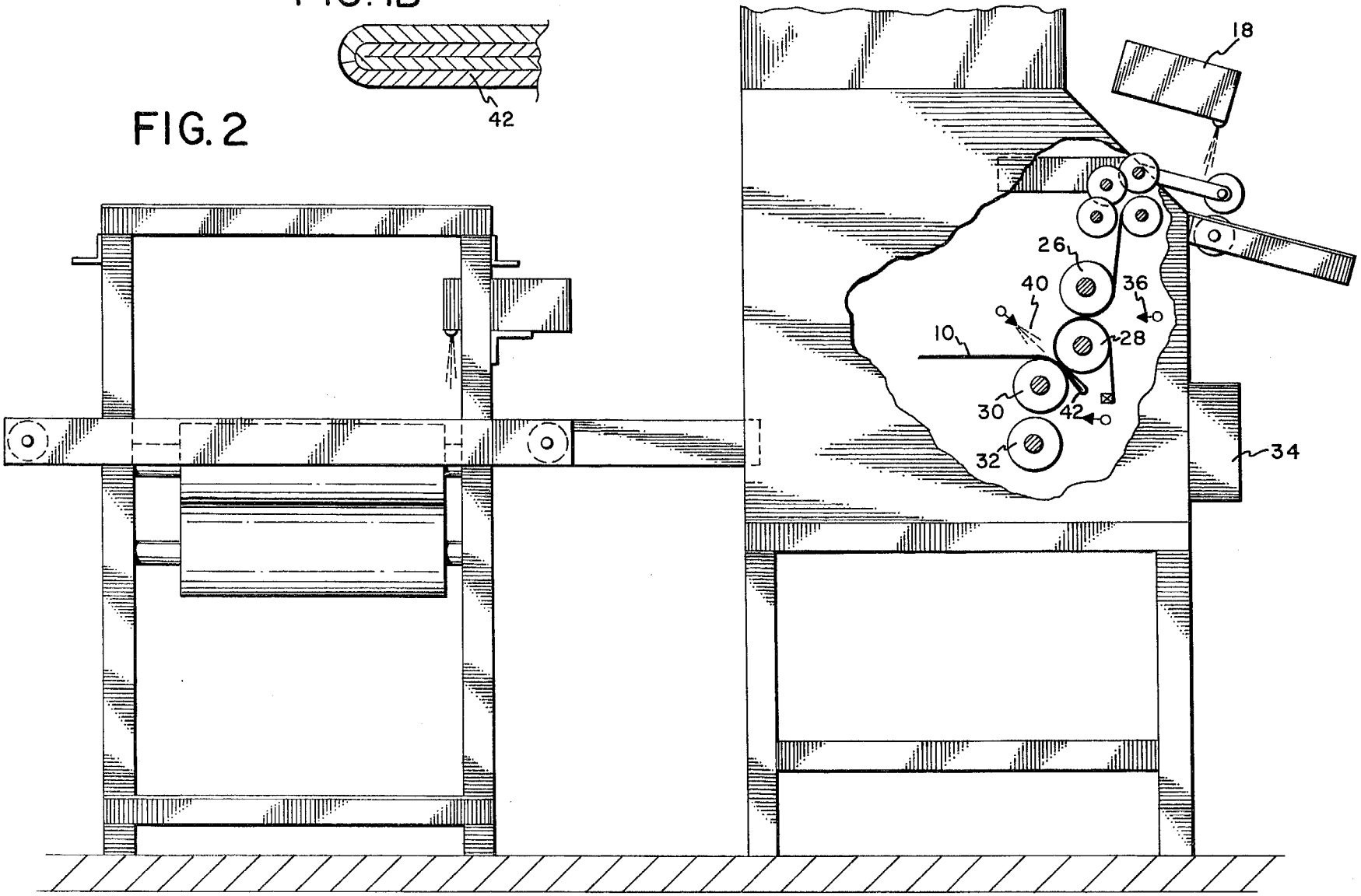
FIG. 1B is a partial sectional view of the second fold.
FIG. 2 is a similar view showing the formation of the second fold.

After a timed interval, the first air jet is formed, and the belt is moved away from rollers 28 and 30 to support the curtain. Then, as shown in FIG. 2, discharge of a second downwardly inclined air jet 40 forces the first folded curtain between rollers 28 and 30 to form the second fold 42. Thereafter, when the trailing edge of the curtain passes through the photocell circuit 34, after another timed interval, the belt is moved toward the rollers 28 and 30.

Figures 1C, 3:
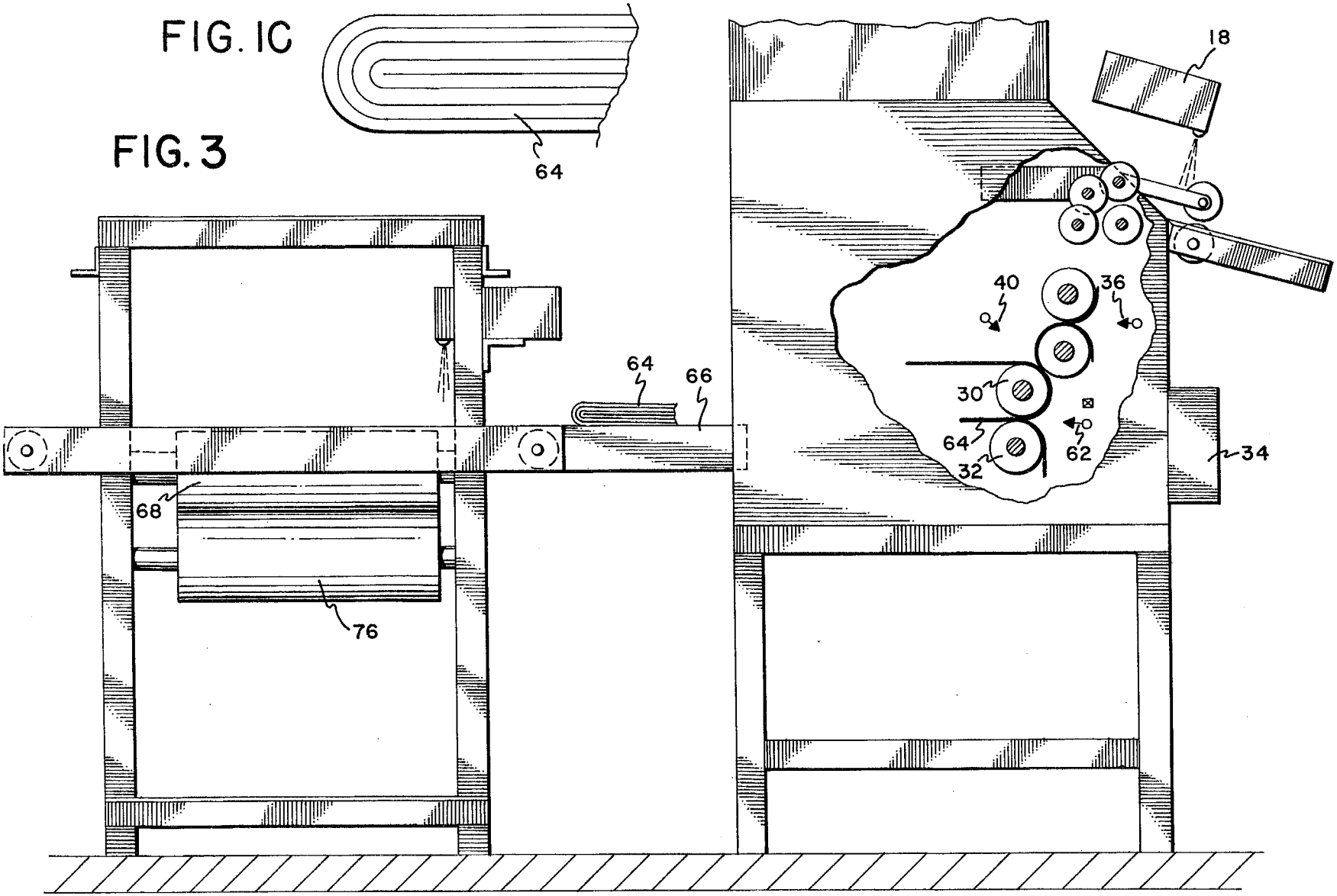
FIG. 1C is a partial sectional view of the third fold.
FIG. 3 is another similar view showing the formation of the third fold.

As shown in FIG. 3, the discharge of a third horizontal air jet 62 forces the twice folded curtain between rollers 30 and 32 to produce the third fold shown at 64. The thrice folded curtain 64 is then carried on a horizontal conveyor 65 over first and second oppositely rotating horizontal parallel rollers.

Figure 4:
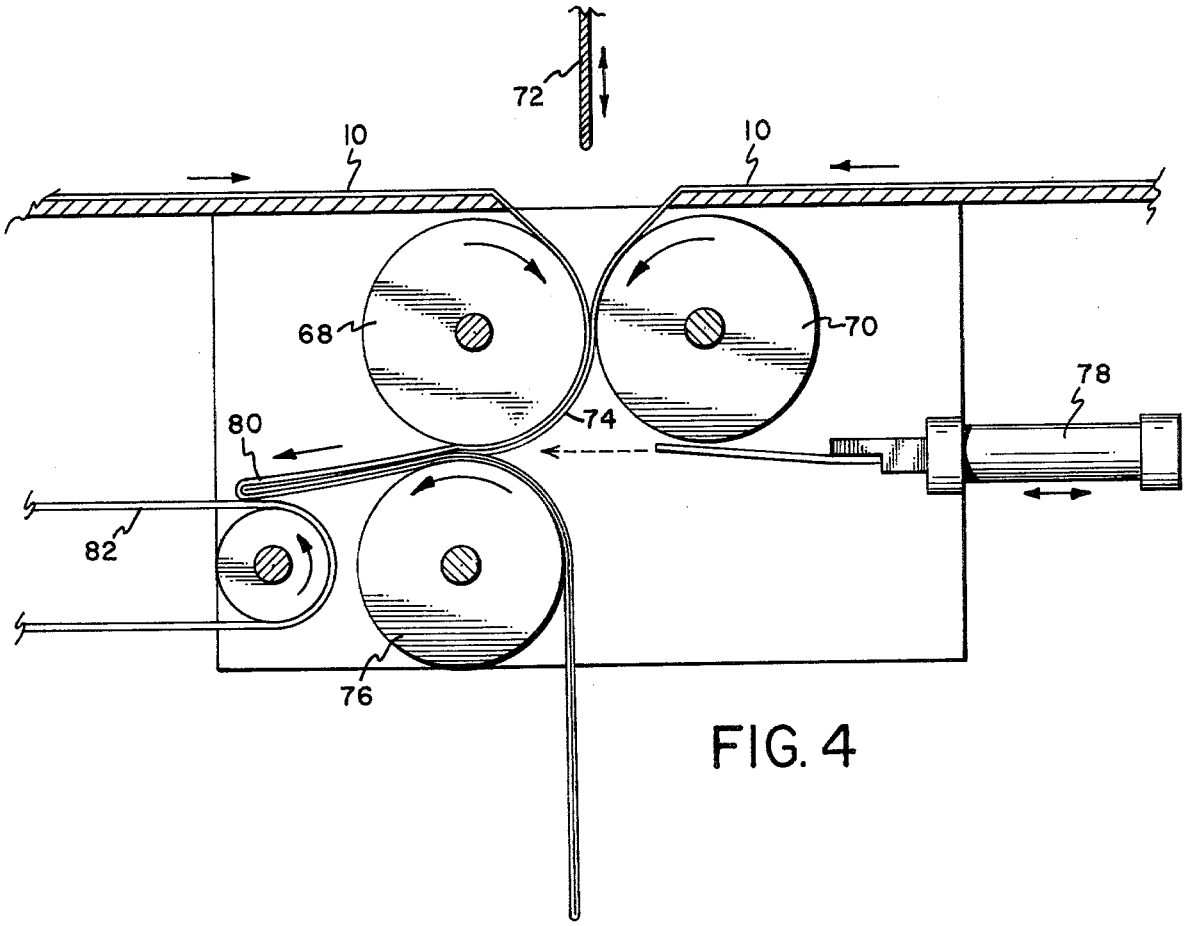
FIG. 4 is an enlarged detail view showing the formation of the fourth and fifth folds.

As shown in FIG. 4, a vertical blade 72 is aligned with the small space between rollers 68 and 70. The blade descends between rollers 68 and 70 to form a fourth cross fold 74. The four times folded curtain is then fed past roller 68 and another roller 76 parallel to and disposed below roller 68. Roller 76 is driven in a direction opposite to roller 68. A horizontal blade 78 is advanced between rollers 68 and 76 to form the fifth and last fold as shown at 80. The folded curtain is fed to horizontal conveyor 82 for subsequent removal and packing.

The remaining Figures illustrate the machine timing and control circuitry. The common or ground connections obvious to those skilled in the art to insure that all components are connected in common have been omitted as necessary to permit ease of illustration and explanation.

As shown in FIG. 6, a manually controlled switch 108 closed by an operator supplies power to motors 104 and 106 which control the remainder of the machine. Motors 104 and 106 thus operate continuously. Initially, the leading edge of curtain 10 is placed in position to break the light beam of photocell circuit 18 and relay 100 is deenergized. The operators each depress a corresponding push button switch 110 whereby relay 112 is energized. This action energizes the solenoid control of wheels 14 whereby the wheels clamp the curtain. At the same time a holding circuit for relay 112 is completed through the contacts of deenergized relay 100. Then the push buttons are released and motor 102 is energized. The curtain is then pulled through the input section. As the trailing edge of the curtain passes through the circuit 18, the light beam strikes the cell and relay 100 is energized. This action disables the holding circuit, relay 112 is deenergized, motor 102 stops and the wheels 14 are raised.

As shown in FIG. 7, the leading edge of the vertical curtain cuts off the light beam in photocell circuit 34 deenergizing relay 200. Clock pulses from the generator 202 pass through the contacts of relay 200 and are made available to the counters 204, 208, 212, 216 and 218 via normally closed gates 206 and 210 to count a selected number of pulses. When any counter counts its individually preset number of pulses, it produces an output signal and automatically recycles.

The clock pulses are fed directly to counter 204. When counter 204 produces its output signal (the first signal), the first output signal is supplied to normally closed gate 206 to open it and pass the clock pulses to counter 208. When counter 208 produces its output signal (the second signal), the second signal is supplied to normally closed gate 210 to open it and pass the clock pulses to counter 212. When counter 212 produces its output signal, (the third signal), the third signal is supplied to normally closed gate 220 to open it and pass the clock pulses to counter 216. This counter, when cycled, produces the fourth signal. When normally closed gate 222 is opened, clock pulses pass to counter 218 which when cycled produces the fifth signal.

As shown in FIG. 8, the first signal opens normally closed gate 300, applying an energizing voltage to relay 302. Voltage is then applied through the closed contact to energize an air solenoid which releases compressed air from a storage tank to a perforated pipe. The air flows through the perforations to form the first air jet and produce the first fold. The first signal also opens normally closed gate 304 and the clock pulses are fed to counter 306. When this counter 306 produces the sixth output signal, this signal is fed to gate 300 to close it again. This deenergizes relay 302, deenergizing the air solenoid and cutting off the air jet. Thus the selected count of counter 306 determines the duration of the first air jet.

Figure 9:
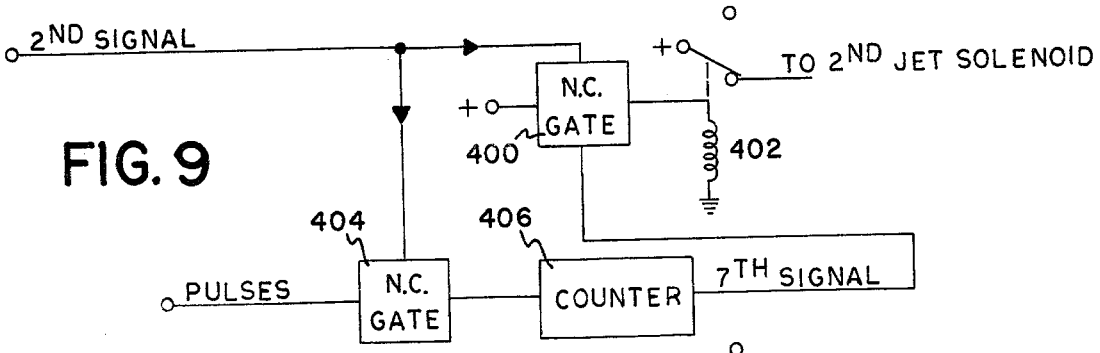

FIG. 9 shows an arrangement similar to that of FIG. 8. The second output signal opens normally closed gate 400, energizing relay 402 and energizing another air solenoid to form the second air jet and produce the second fold. The second signal also opens normally closed gate 400 and clock pulses are fed to counter 406. When counter 406 produces the seventh output signal, this seventh signal is fed to gate 400 to close it again and deenergize relay 402, thus cutting off the second air jet. The selected count of counter 406 determines the duration of the second air jet.

Figure 10:
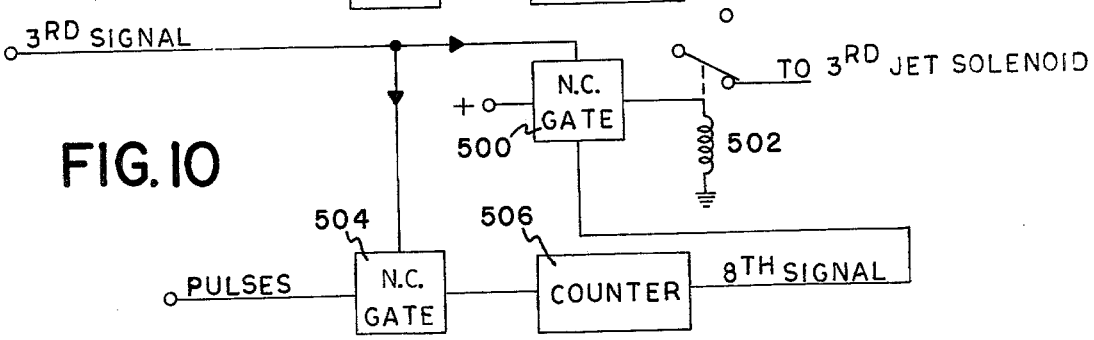

FIG. 10 shows an arrangement similar to that of FIG. 8. the third output signal opens normally closed gate 500, energizing relay 502 and energizing yet another air solenoid to form the third air jet and produce the third fold. The third signal also opens normally closed gate 504 and clock pulses are fed to counter 506 When counter 506 produces the eighth output signal, this signal is fed to gate 500 to close it again and Relay 502 is deenergized, cutting off the third air jet. The selected count 506 determines the duration of the third air jet.

Figure 11:
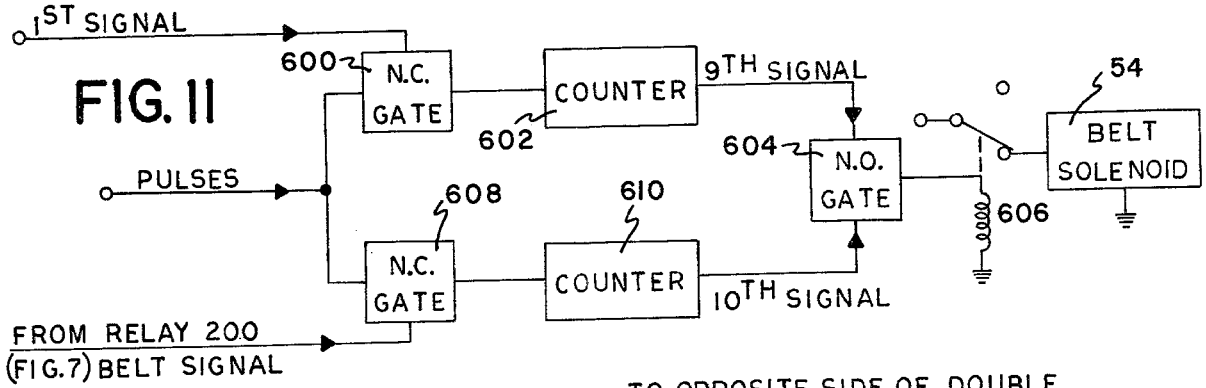

FIG. 11 illustrates the control of the stripper belt assembly. The belt assembly is normally positioned adjacent rollers 28 and 30 as explained with reference to FIG. 5. This position can be obtained by energizing the stripper belt solenoid 54 so that its armature is pulled in. The opposite position of the belt assembly spaced from rollers 28 and 30 can be obtained by deenergizing the solenoid so that its armature is extended.

Normally, normally open gate 604 is open, relay 606 is energized and belt solenoid 54 is energized. However, when the first air jet is formed, the first signal opens normally closed gate 600 and clock pulses are fed to counter 602. When this counter has completed its cycle, it produces a ninth signal, closing gate 604, deenergizing relay 606 and belt solenoid 54. The armature is extended and the belt assembly is moved away from rollers 28 and 30. When the trailing edge of the curtain passes circuit 34 (as shown in FIG. 7), relay 200 is deenergized, normally closed gate 608 is opened, and clock pulses are fed to counter 610. When this counter has completed its cycle, it produces a tenth signal, opening gate 604 again, whereby the relay 606 and belt solenoid 54 are energized, the armature is pulled up and the belt assembly is moved toward rollers 28 and 30.

Figure 12:
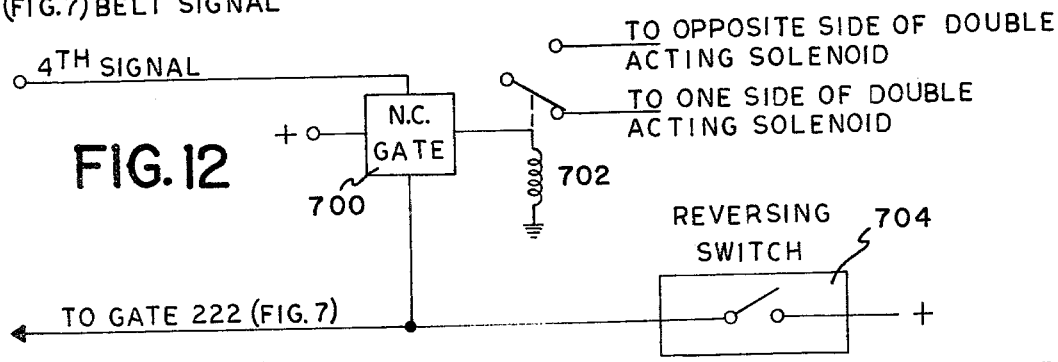

The vertical blade which produces the fourth fold is controlled by a double action air cylinder under the control of a single vertical blade solenoid. When this vertical blade solenoid is energized, air is supplied to one end of an air cylinder, raising a plunger therein secured to the blade whereby the blade is raised. When this vertical blade solenoid is deenergized, air is supplied to the opposite end of the air cylinder, lowering the plunger and lowering the blade. The vertical blade solenoid and air cylinder are used in the prior art machine. However, the control of this solenoid and cylinder in the invention is obtained by the use of the fourth signal as shown in FIG. 12. Relay 702 is normally deenergized whereby the vertical blade solenoid is deenergized and the blade is held in raised position. When the fourth signal is produced, normally closed gate 700 is opened, relay 702 is energized and the vertical blade solenoid is energized whereby the blade is lowered and the fourth fold is produced. As the blade bottoms, it closes a normally open reversing switch 704, whereby a voltage is supplied to gate 700 to close it again. This causes the blade to be returned to normal position.

When switch 704 is closed, as shown in FIGS. 12 and 7, the normally closed gate 220 is opened and the fifth signal is produced. Hence the bottoming of the vertical blade initiates the action of the horizontal blade.

Figure 13:
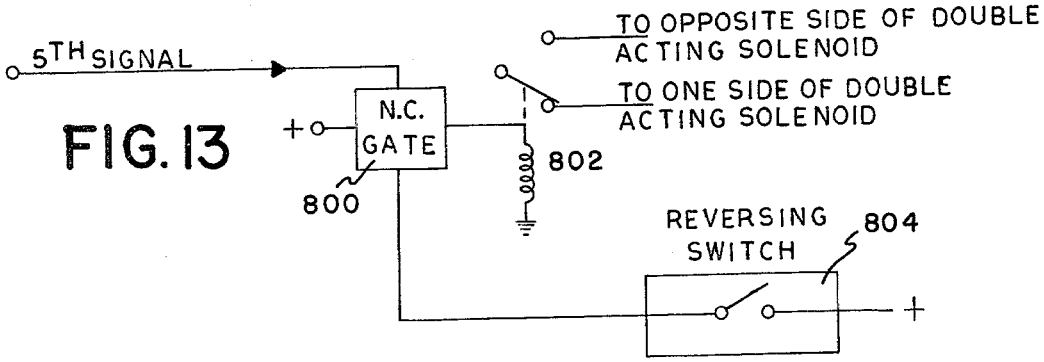

As shown in FIG. 13, relay 802 is normally deenergized whereby a horizontal blade solenoid controlling the double acting air cylinder is deenergized, and air is supplied to one end of another air cylinder withdrawing the plunger secured to the horizontal blade whereby the horizontal blade is withdrawn from the curtain. When the fifth signal is produced, normally closed gate 800 is opened, relay 802 is energized, the horizontal blade solenoid is energized, whereby the horizontal blade is advanced and the fifth fold is produced. As the horizontal blade reaches its extreme extended position, it closes another normally open reversing 804, whereb a voltage is supplied to gate 800 to close it again. This causes the horizontal blade to be returned to normal position.

Typically, the pulse recurrence frequency is 120 Hz and the pulse width is adjusted as necessary using a portion of each half cycle of the 60 Hz 120 volt source to form each pulse.

It will be obvious to those skilled in the art that other arrangements of gates and relays can be used with the counters and photocell circuits described herein to produce the same timing and control.

While the invention has been described with particular reference to the drawings, the protection sought is to be limited only by the terms of the claims which follow.

What is claimed is:

1. In a folding machine having first, second and third means to produce corresponding first, second and third jets of air respectively under the respective control of a corresponding one of first, second and third solenoids, each of the first, second and thrid jets being produced with the corresponding one of the first, second and third solenoids is actuated and being cut off when the corresponding one of the solenoids is deactuated, in combination:

a source of clock pulses;

first, second, third, fourth, fifth and sixth pulse counters, each counter being present to count a selected number of pulses and to produce an output signal when the counter has completed a count cycle;

means to supply said pulses to said first counter, said first counter producing a first output signal when its cycle is completed;

means responsive to said first signal to actuate said first solenoid to actuate said first means to produce said first air jet and simultaneously to allow said pulses to be supplied to said second counter, said second counter producing a second output signal when its cycle is completed;

means responsive to said second signal to deactuate said first solenoid and cut off said first air jet whereby the duration of said first air jet is determined by the cycle period of said second counter;

means responsive to said second signal to supply said pulses to said third counter, said third counter producing a third output signal when its cycle is completed;

means responsive to said third signal to actuate said second solenoid to actuate said second means to produce said second air jet and simultaneously to allow said pulses to be supplied to the fourth counter, said fourth counter producing a fourth output signal when its cycle is completed;

means responsive to said fourth signal to deactuate the second solenoid and cut off said second jet whereby the duration of the second jet is determined by the cycle period of the fourth counter;

means responsive to said third signal to supply said pulses to said fifth counter, said fifth counter producing a fifth output signal when its cycle is completed;

means responsive to said fifth signal to actuate said third solenoid to actuate said third means to produce said third air jet and simultaneously to allow said pulses to be supplied to the sixth counter, said sixth counter producing a sixth output signal when its cycle is completed; and means responsive to said sixth signal to deactuate the third solenoid and cut off said third jet whereby the duration of the third jet is determined by the cycle period of the sixth counter.

2. The combination of claim 1 wherein the machine also empolys a veritcal blade under the control of a vertical blade solenoid, the vertical blade being lowered when the vertical blade solenoid is energized and being raised when the vertical blade solenoid is deenergized, the combination further including:

a seventh pulse counter;

means responsive to said sixth signal to supply said pulses to the seventh counter, said seventh counter producing a seventh output signal when its cycle is completed; and means including a reversing switch and resposnive to said seventh signal to energize the vertical blade solenoid, said switch being actuated when the blade bottoms to cause said vertical blade solenoid to be deenergized.

3. The combination of claim 2 wherein the machine also employs a horizontal blade under the control of a horizontal blade solenoid, the horizontal blade being extended when the horizontal blade solenoid is energized and being withdrawn when said horizontal blade solenoid is deenergized, the combination further including:

an eighth pulse counter;

means responsive to said actuated reversing switch to supply said pulses to the eighth counter, the eighth counter producing an eighth output signal when its cycle is completed; and means including another reversing switch and responsive to said eighth signal to energize the horizontal blade solenoid, said another switch being actuated when the horizontal blade is fully extended to cause said horizontal blade solenoid to be deenergized.

4. In a folding machine having first means to produce a first jet of air under the control of a first solenoid, said first jet being produced when the first solenoid is actuated and being cut off when the first solenoid is deactuated, said machine also having means for feeding a curtain to be folded vertically downward past the first jet, in combination:

a source of clock pulses;

first and second pulse counters, each counter being present to count a selected number of pulses and to produce an output signal when the counter has completed a count cycle;

means to supply said pulses to said first counter, said first counter producing a first output signal when its cycle is completed;

means responsive to said first signal to actuate said first solenoid to actuate said first means to produce said first air jet and simultaneously to allow said pulses to be supplied to said second counter, said second counter producing a second output signal when its cycle is completed;

means responsive to said second signal to deactuate said first solenoid and cut off said first air jet whereby the duration of said first air jet is determined by the cycle period of said second counter;

a photoelectric cell circuit responsive to the passage therethrough of said vertical curtain, said circuit being actuated in the absence of said curtain and being deactuated in the presence of said curtain; and means interposed between said pulse supply means and said first counter and coupled to said circuit, said interposed means preventing pulses from being supplied to said first counter when the circuit is actuated and permitting said pulses to be supplied to said first counter when said circuit is deactuated.

5. The combination of claim 4 wherein said machine also employs a stripper belt assembly controlled by a belt solenoid, said assembly being moved toward the jet when the belt solenoid is actuated and being moved away from the jet when the belt solenoid is deactuated, the combination further including:

two assembly counters;

means responsive to said first signal to supply said pulses to one of said assembly counters, said one assembly counter producing one assembly output signal when its cycle is completed;

means responsive to the actuation of said circuit to supply said pulses to the other of said assembly counters, said other assembly counter producing another assembly output signal when its cycle is completed; and means responsive to said one and said another assembly output signals, said means when responding to said one assembly output signal actuating the belt solenoid, said means when responding to said other assembly output signal deactuating the belt solenoid.

6. In a machine for folding curtains and the like wherein an input section controlled by a first motor receives a curtain for folding in almost horizontal position and discharges the curtain in vertical position below the input section, said input section being actuated when the first motor is energized and being deactuated when the first motor is deenergized, the combination comprising:

a photoelectric cell circuit which is actuated when its light beam is not interrupted and is deactuated when the light beam is interrupted, said circuit being disposed adjacent the input section in a position at which the leading edge of the curtain received for folding interrupts said beam and deacactuates said circuit, said circuit being actuated after the trailing edge of the curtain passes through said circuit; and manually operated means for energizing said motor when the circuit is deactuated, said means including a holding circuit, said holding circuit being disabled by action of the photocell circuit when the photocell circuit is actuated.

7. The combination of claim 6 wherein said machine is provided with a subsequent folding section using air jets which are disposed below the input section, the combination further including:

another photoelectric cell circuit disposed adjacent the folding section, said another circuit being deactuated when the leading edge of the vertically discharged curtain passes thereby; and means coupled to said another circuit for initiating the action of the air jets when said another circuit is deactuated.

8. The combination as set forth in claim 7 wherein said means coupled to said another circuit for initiating the action of the air jets includes a source of clock pulses and a plurality of pulse counters.

* * * * *